US005940988A

United States Patent [19]

Eisen

[11] Patent Number: 5,940,988

[45] Date of Patent: Aug. 24, 1999

[54] APPARATUS AND METHOD FOR DRY CLEANING

[76] Inventor: Daniel Eisen, 404 Brookside La., Hillsborough, N.J. 08876

[21] Appl. No.: 09/027,793

[22] Filed: Feb. 23, 1998

[51] Int. Cl.[6] ..... F26B 11/02

[52] U.S. Cl. ..... 34/596; 8/159; 68/19.2

[58] Field of Search ..... 34/443, 467, 470, 34/60, 61, 85, 596, 597; 8/159; 68/18 C, 18 F, 19.2, 20, 24

[56] References Cited

U.S. PATENT DOCUMENTS

| | | | |
|---|---|---|---|
| 4,483,160 | 11/1984 | Jost | 68/18 C |
| 4,984,318 | 1/1991 | Coindreau-Palau | 8/159 X |
| 5,107,606 | 4/1992 | Tsubaki et al. | 34/596 |
| 5,212,969 | 5/1993 | Tsubaki et al. | 34/596 X |
| 5,537,761 | 7/1996 | Oh | 34/596 |

*Primary Examiner*—Henry Bennett
*Assistant Examiner*—Steve Gravini
*Attorney, Agent, or Firm*—Ezra Sutton

[57] ABSTRACT

A dry cleaning apparatus including a housing having a door and an internal rotatable drum for receiving clothes to be cleaned, a motor and pulley system for rotating the drum, and a heating element having an air circulation blower for heating the clothes in the drum. The dry cleaning apparatus further includes a first hose connected to the housing for supplying pressurized air to the drum, a second hose connected to the housing for supplying water or water vapor to the clothes in the drum, and a third hose and vacuum pump connected to the housing for evacuating air and/or fine particulate matter from the drum.

A method of dry cleaning garments includes the steps of: placing clothes in a rotatable drum of a dry cleaner, supplying a chemical in liquid or gas form to the drum to remove odors from the clothes in the pressurized drum, pressurizing the air in the drum to clean the clothes therein, supplying water or water vapor to the clothes in the pressurized drum, supplying a chemical fabric conditioner to condition the clothes in the pressurized drum, and evacuating air and filtering out fine particulate matter from the pressurized drum.

23 Claims, 9 Drawing Sheets

FIGURE 7A

200 DRY CLEANING PROCEDURE

210 STEP 1
EXAMINING/INSPECTING

The clothing garments are examined and a decision is made by the dry cleaning operator on what stains should be prespotted by an appropriate destaining liquid solvent and steamed.

220 STEP 2
STAIN REMOVING

221 2A: PERSPIRATION AND WETSIDE STAINS will be steamed and lubricated by a wetside biodegradable lubricant to remove odors, fatty acids and salts.

222 2B: TANNIN STAINS will be treated by the use of acids, tannin formula destaining liquids and bleach to remove tannin stains caused by coffee, tea, soft drinks, soy sauce, mustard and the like.

223 2C: PROTEIN STAINS will be treated by the use of alkalis, protein formula destaining liquids and bleach to remove protein stains caused by egg, milk, blood, living body matter and the like.

224 2D: DRYSIDE STAINS will be treated by the use of nonionic detergents to remove dryside stains caused by grease, oils, dyes, waxes and the like.

225 2E: DIRT AND HEAVY SOIL STAINS will be treated by the use of wetside lubricants and/or ammonia depending upon the tenacity of the stain and the type of fabric being prespotted.

230 STEP 3
AIR FLUSHING AND FEATHERING

The clothing garments will be carefully flushed and feathered by the operator using compressed (oil free) air. Feathering is a technique that blends a wet area into a dry area so that stain rings are avoided.

FIGURE 7B

240

STEP 4
PROGRAMMING THE CLEANING AND CONDITIONING TREATMENTS

A programmable control panel 190 may be used for controlling several of the cleaning steps and/or conditioning steps of a garment being cleaned. These cleaning and conditioning steps may be manually or automatically operated by the dry cleaner operator.

250

STEP 5
DRYER CONDITIONING

The clothing garments are then placed into dry cleaning dryer (as a normal dryer) where the dryer temperature is set at a 110°F to avoid setting any of the stains that are to be removed. The warm temperature within the dryer gently evaporates and removes the moisture from the clothing garments such that the dirt and soil from the fabrics can more easily be removed.

260

STEP 6
GASEOUS CLEANING AND CONDITIONING

262

6A: OZONE ($O_3$) TREATMENT for removing noxious odors (an optional treatment) such as smoke, food smells, perspiration and the like.

264

6B: AMMONIA ($NH_3$) TREATMENT for removing noxious acid based odors (an optional treatment) such as food smells and the like.

270

STEP 7
LIQUID CLEANING AND CONDITIONING

272

7A: BAKING SODA ($Na_2CO3$) TREATMENT for removing noxious acid based odors (an optional treatment) such as egg, living body matter and the like.

274

7B: CARBONIC ACID ($H_2CO_3$) [CLUB SODA] TREATMENT for removing noxious odors when ammonia treatment is not applicable (an optional treatment) such as food smells and the like.

2

FIGURE 7C

280

STEP 8
PRESSURIZED AIR CLEANING

For removing the soil, dirt, dust, lint and stains from the garments being cleaned. The intensity of air pressure depends upon the type of fabric being processed, a higher air pressure can be used for furs, leather and suedes and a lower air pressure can be used for more delicate type fabrics such as silk, nylon, or rayon. The vacuum pump is used in a cycling process to remove the loosened impurities from the basket/drum and garments being processed. The time of processing of the garments using a positive air pressure, then vacuum cycle is approximately 10 to 15 minutes. A pressure vent can be opened to reduce pressure within the basket chamber while the garments are being cleaned.

290

STEP 9
RE-INSPECTING & EXAMINING

The clothing garments are re-inspected and examined again such that the operator can again spot using an appropriate destaining solution if necessary when the garment has been adequately cleaned, and Step 7 is repeated again.

300

STEP 10
PURIFYING AND STERILIZING

The clothing garments are then replaced into the basket chamber of the rotatable drum for purification where the temperature should reach 140°F to destroy most types of bacteria, fungi and microorganisms.

310

STEP 11
COOLING

The clothing garments are cooled to 75° to 85°F for further processing.

FIGURE 7D

320 STEP 12
WATER CONDITIONING

Water vapor is supplied to the basket chamber of the rotatable drum where the water vapor is used to increase the moisture content of the fabric being cleaned. This increase in the moisture content will make the pressing procedure easier.

330 STEP 13
FABRIC CONDITIONING

332 13A: STARCH SIZING SOLUTION is used to add body to the clothing garment being cleaned in order to make finishing easier (an optional treatment)

334 13B: FABRIC SURFACE AND CONDITIONING SOLUTION is used to add a luster/shine to the fabric of the clothing garment being cleaned before the pressing procedure (an optional treatment).

336 13C: WATER REPELLANT SOLUTION is used to water proof the clothing garment being cleaned (an optional treatment).

340 STEP 14
EVACUATING THE AIR AND PARTICULATE MATTER

Air pressure from the rotatable drum is evacuated by the use of the vacuum pump and the remaining particulate from the processing is removed from the basket filter. The clothing garments are given a final examination of processing done.

350 STEP 15
PRESSING

The clothing garment is now ready for the pressing out of the cleaned garment. The clean garment is then hung on a hanger and plastic wrapped and readied for the customer pick-up.

APPARATUS AND METHOD FOR DRY CLEANING

FIELD OF THE INVENTION

The present invention relates to an improved apparatus and method for dry cleaning, and more particularly, to a method of dry cleaning that eliminates the use of dry cleaning solvents in the removal of dirt, soil and stains from clothing.

BACKGROUND OF THE INVENTION

Dry cleaning operators have a difficult time operating a dry cleaning establishment on a day to day basis due to the various Federal, State, County and City laws and regulations that control and govern the use of specific dry cleaning solvents that may be harmful to the operator and/or customer, as well as the emission of dry cleaning fumes and odors emanating from the dry cleaning plant. In order to operate a dry cleaning plant, the dry cleaner must abide by these tough laws, regulations and standards or the operator is subject to large fines and/or closure of the dry cleaning plant in operation. This means the dry cleaning operator must purchase new dry cleaning equipment referred to as fourth generation cleaning machines or add-on equipment that reduces odors in the dry cleaning machines referred to as third generation dry cleaning machines. Many dry cleaning owners will be forced to purchase this new type of equipment and/or purchase expensive add-on equipment in order to stay in business.

Another major problem dry cleaning operators encounter is hazardous waste disposal from their dry cleaning plants, as the operators cannot throw away any liquid waste from their dry cleaning equipment. This hazardous liquid waste must be picked up by a licensed hazardous waste company and this waste removal pickup is quite costly. Water waste from the dry cleaning equipment is similarly picked up by the licensed hazardous waste firm or disposed of by special liquid transfer equipment which is also very expensive.

Federal, State, County and City governments also have strict regulations on using dry cleaning equipment in mix-use buildings or buildings having family occupancy. Dry cleaning establishments in such buildings, as mentioned above, require special rooms to contain the solvent fumes, and for storing of the solvents and solvent contaminates. These rooms require proper air flow transfer and the measurement of solvent fumes coming from these special rooms are strictly enforced by inspectors from various Federal, State, County and City agencies such as the EPA, DEP, OSHA, and Department of Health. These inspectors on a regular basis shut-down many dry cleaning plants that do not comply with these regulations. In addition, the dry cleaner owner is also required to keep extensive records of their overall operational procedures and make weekly self-inspections of their equipment. A further problem dry cleaning owners have to deal with is the common practice where landlords of the aforementioned buildings refuse to lease to dry cleaning stores or not renew their current leases because of complaints by tenants and neighbors.

Present day procedures for dry cleaning include chemical (spot) cleaning or wet cleaning of garments. In chemical cleaning of garments, the dry cleaning operator initially spot cleans a particular stain, soil or dirt mark with a specific liquid chemical. Additionally, the operator can also spot clean again a stubborn stain, soil or dirt mark after the initial dry cleaning procedure has been completed. Next, the dry cleaner operator loads the clothing garments into a dry cleaning machine filled with a dry cleaning solvent such as perchloroethylene. Perchloroethylene solvent is very expensive to purchase even though it is reused many times and this solvent may also contain dry cleaning soaps to aid in removing soil and stains. The dry cleaning machines use pumps to transfer the solvent to the wheel or basket that contain the clothing garments to be cleaned. The dry cleaning solvent is filtered many times during the dry cleaning procedure to remove the dirt and soil from the wheel which prevents any redepositing of dirt and soil back on the clothing garments being cleaned. The next step after the previous cleaning cycle has been completed, is where the clothing garments are extracted from the dry cleaning machine after a high speed spinning cycle such that the dry cleaning solvent is drained away from the clean clothing garments and the wheel. Next, after extraction from the wheel, the cleaned garments are then dried using water cooling, refrigeration and heat within the clothes dryer. After drying, fumes from the wheel or basket are removed by special equipment such as carbon absorbers, where the operators do a distillation process to remove the waste from the cleaning solvent such that solvent can be reused again. The waste and water coming from the dry cleaning machine is hazardous waste and must be disposed of properly. Some fabrics cannot be chemically dry cleaned even though they are labeled as "dry clean only", as these fabrics may bleed, shrink, lose color, have coating separation, melted beads and fabric fusing problems.

In wet cleaning of garments, the dry cleaning operator uses water, special soaps and temperature control of the cleaning liquid to safely clean many types of fabrics. Statistically, the wet cleaning procedures as demonstrated by professional standards are only good for 40 to 50% of the clothing garments received by dry cleaning establishments. Problems associated with wet cleaning include bleeding, shrinkage, losing of color, and wrinkling. The wet cleaning of fabrics by the dry cleaning operator also faces the hard task of extensive time consuming pressing procedures to stretch garments that move, shrink and do not press-out properly; and additionally remove hard set wrinkles, and to stretch-out and press garments shrunken in size. The dry cleaning operator who wet cleans most or all fabrics faces the labor intensive procedure of stretching shrunken fabrics and removing hard set wrinkles and this procedure is not a viable option for most dry cleaning operations as it reduces profits. Common customer complaints on using the wet cleaning procedure for garments have been loss of texture, feel, body and lack of luster to the fabric being cleaned.

There remains a need for an improved apparatus and method for dry cleaning of clothing garments made from various types of fabrics, leathers and furs using environmentally safe dry cleaning gases and solutions which provide a safe dry cleaning procedure that reduces the operating cost of dry cleaning. Additionally, there is a need for an improved dry cleaning apparatus and method which will eliminate odors, the need for auxiliary equipment or solvent containment rooms, as well as, the need for expensive hazardous waste removal by a licensed waste removal company.

DESCRIPTION OF THE PRIOR ART

Dry cleaning dryers, cleaning and drying machines, and dry cleaning systems having various designs, structures, configurations and materials of construction have been disclosed in the prior art. For example, U.S. Pat. No. 4,819,459 discloses a front loading dry cleaning machine capable of being tipped forwardly about 90° degrees such that the front door is next to the floor. This makes the rear of the cleaning machine accessible for repair of the drive mechanism mounted thereon. This prior art patent does not disclose the design, structure and configuration of the present invention.

U.S. Pat. No. 3,583,180 discloses a solution injection nozzle for injecting a sizing solution into the rotary drum of a dry cleaning machine. The sizing solution is injected in mist form into the vacant space in the rotary drum of the machine by a stationary nozzle located to register with a slot in the flange of the rotating drum. The injecting nozzle includes a valve which is automatically operated by a cam located on the drum flange adjacent to the slot. This prior art patent does not disclose the design, structure and configuration of the present invention.

U.S. Pat. Nos. 4,086,705; 4,622,039; and 5,442,938 disclose dry cleaning systems and dry cleaning machines using dry cleaning solvents therein having a solvent recovery unit to recover the solvents. None of these aforementioned prior art patents disclose the design, structure and configuration of the present invention.

These prior art patents do not disclose or teach the use of a dry cleaning dryer apparatus and method for the cleaning of soiled clothing garments in an environmentally safe manner having the design, structure and configuration of the present invention.

Accordingly, it is an object of the present invention to provide an improved method and apparatus for the dry cleaning of clothing made from various types of fabrics, leathers and furs using environmentally safe dry cleaning liquids which provide a safe dry cleaning procedure that reduces the operating costs of dry cleaning equipment, dry cleaning materials, labor, management record keeping for various governmental agencies and overhead expense.

Another object of the present invention is to provide an improved dry cleaning apparatus and method that will eliminate odors, the need for auxiliary equipment or solvent containment rooms, the need for hazardous waste removal by a licensed waste removal company and the need for dry cleaning machines using dry cleaning solvents such as perchlorethylene.

Another object of the present invention is to provide an improved dry cleaning apparatus and method that reduces the intervention and record keeping required by various Federal, State, County and City governmental agencies such as the EPA, OSHA, DEP and the Health Department.

Another object of the present invention is to provide an improved dry cleaning apparatus and method that give customers options of alternate cleaning procedures and processes which are environmentally safe to the health of the dry cleaning operators and customers, as well as being environmentally safe to the surrounding areas of the dry cleaning establishments.

Another object of the present invention is to provide an improved dry cleaning apparatus and method that avoids the problems of fabric shrinkage; fabric dye bleeding; loss of color in the fabric; fabric fusing; melted beads; coating separations within the fabric; loss of fabric texture, feel and body; lack of fabric luster; and other associated problems that can arise in either chemical dry cleaning or wet cleaning procedures being used at present.

Another object of the present invention is to provide an improved dry cleaning apparatus that is pressurized by air and the amount of air pressure can be regulated depending upon the fabric being cleaned.

Another object of the present invention is to provide an improved dry cleaning apparatus that receives a variety of gases such as ozone, ammonia or other cleaning gases for the removal of noxious odors like smoke, sweat/perspiration, garlic/onion smells, and the like.

Another object of the present invention is to provide an improved dry cleaning apparatus that applies a moisture spray to the garment being cleaned to increase the moisture content of the fabric in order to make pressing of the garment easier.

Another object of the present invention is to provide an improved dry cleaning apparatus that applies a starch sizing solution to the garment being cleaned in order to add body to the fabric in order to make pressing and finishing of the clean garment easier.

Another object of the present invention is to provide an improved dry cleaning apparatus that applies a fabric surface finishing solution to the garment being cleaned to add luster and shine to the fabric in order to make finish pressing of the garment easier.

Another object of the present invention is to provide an improved dry cleaning apparatus that applies a water repellant solution to the garment being cleaned for water repellency of the fabric in order to make the garment water proof.

Another object of the present invention is to provide an improved dry cleaning method that uses environmentally safe cleaning liquids such as biodegradable wetside lubricants to remove odors, fatty acid and salt stains caused by perspiration of underarm and crotch areas; the use of acids, tannin formulas and bleach to remove tanning stains caused by coffee, tea, soft drinks, soy sauce, mustard and the like; the use of alkalis, protein formulas and bleach to remove protein stains caused by egg, milk, blood, living body matter and the like; and the use of nonionic detergents to remove dryside stains caused by grease, oils, dyes, waxes and the like.

A further object of the present invention is to provide an improved dry cleaning apparatus that can be mass produced in an automated and economical manner and is readily affordable by the dry cleaning owner.

A still further object of the present invention is to provide an improved dry cleaning method that reduces the overall dry cleaning operating costs in dry cleaning of garments in order to reduce dry cleaning prices to the consumer.

SUMMARY OF THE INVENTION

In accordance with the present invention, there is provided a dry cleaning apparatus for cleaning garments in an environmentally safe manner. The dry cleaning apparatus includes a housing having a door, an internal rotatable drum for receiving clothes to be cleaned, a motor and pulley system for rotating the drum, and a heating element have an air circulation blower for heating the clothes in the drum. The dry cleaning apparatus further includes a first hose connected to the housing for supplying pressurized air to the drum, a second hose connected to the housing for supplying water or water vapor to the clothes in the drum, and a third hose and vacuum pump connected to the housing for evacuating air and/or fine particulate matter from the drum.

A method of dry cleaning garments is provided, which includes the steps of placing clothes in a rotatable drum of a dry cleaner, supplying a chemical in liquid or gas form to the drum to remove odors from the clothes in the pressurized drum, pressurizing the air in the drum to clean the clothes therein, supplying water or water vapor to the clothes in the pressurized drum, supplying a chemical fabric conditioner to condition the clothes in the pressurized drum, and evacuating air and filtering out fine particulate matter from the pressurized drum.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein:

FIG. 7A is a schematic block diagram of the method of dry cleaning a clothing garment showing the steps of examining and inspecting, stain removing, and air flushing and feathering that are performed in the cleaning process of the present invention;

FIG. 7B is a schematic block diagram of the method of dry cleaning a clothing garment showing the steps of programming the cleaning and conditioning treatments, dryer conditioning, gaseous cleaning and conditioning, and liquid cleaning and conditioning that are performed in the cleaning process of the present invention;

FIG. 7C is a schematic block diagram of the method of dry cleaning a clothing garment showing the steps of pressurized air cleaning, re-inspecting and examining, purifying and sterilizing, and cooling that are performed in the cleaning process of the present invention; and FIG. 7D is a schematic block diagram of the method of dry cleaning a clothing garment showing the steps of water conditioning, fabric conditioning, evacuating the air and filtering out the particulate matter, and pressing that are performed in the cleaning process of the present invention.

DETAILED DESCRIPTION OF THE PREFERRED EMBODIMENT

Figure 1:
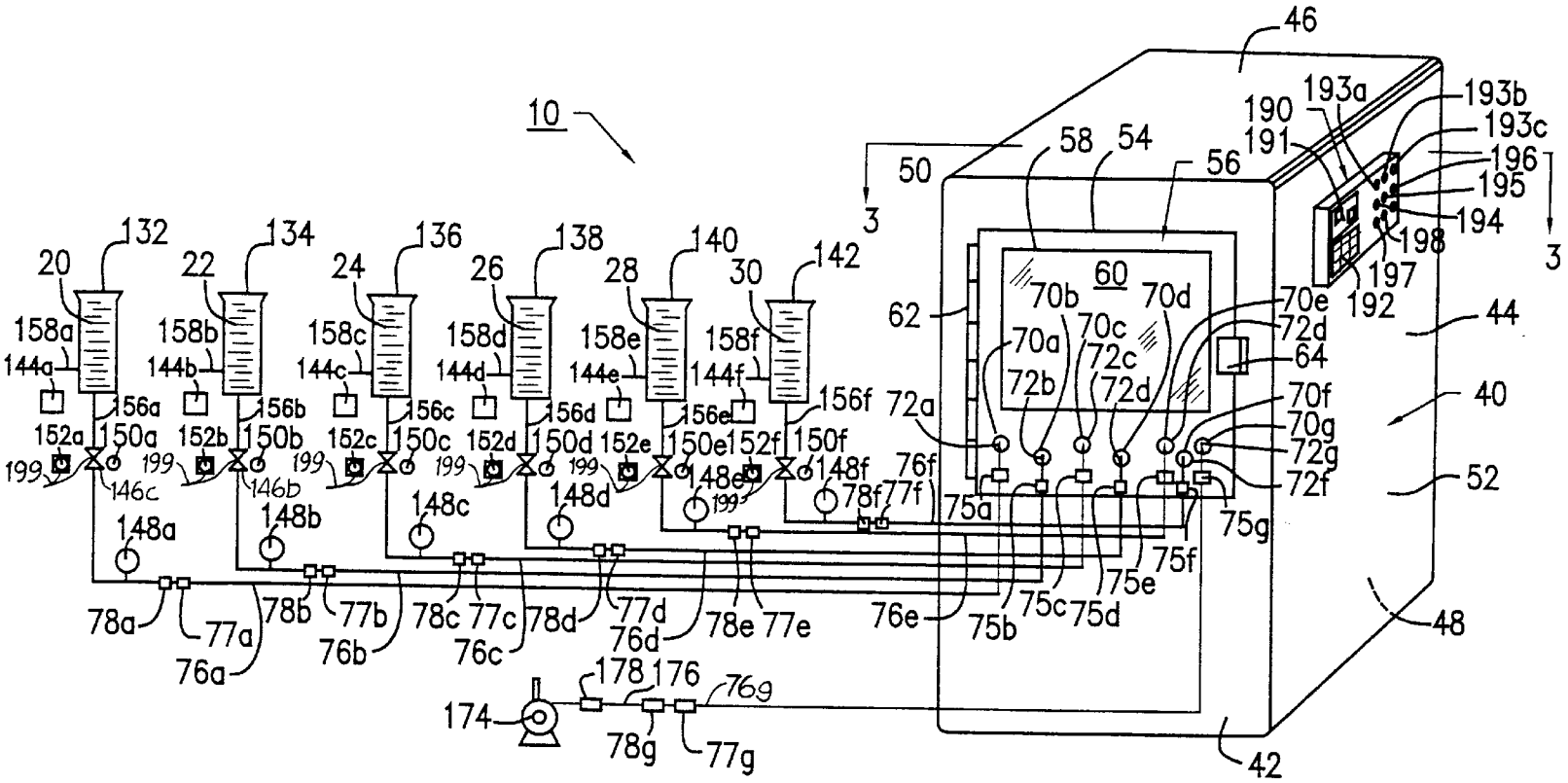
FIG. 1 is front perspective view of the dry cleaning apparatus of the preferred embodiment of the present invention showing the major component parts contained thereon.

The dry cleaning dryer apparatus 10 and its component parts of the preferred embodiment of the present invention are represented in detail by FIGS. 1 through 6 of the drawings. The method 200 of dry cleaning clothing garments 12 having various operational steps performed in the dry cleaning process is disclosed in the preferred embodiment of the present invention and is represented in detail by FIGS. 7A through 7D of the drawings.

The dry cleaning dryer apparatus 10 includes a dryer housing 40 having a substantially rectangular configuration for holding a rotatable basket or drum 82, a drum shaft assembly 94, a pulley system assembly 106, a motor 122, a dryer filter 126, a heating element 128 having an internal air circulation blower 130, and a programmable control panel 190. The dry cleaning dryer apparatus 10 further includes a plurality of liquid containment vessels 132, 134, 136, 138, 140 and 142 for holding water 20, odor removing solutions 22 and 24 and fabric conditioner solutions 26, 28 and 30, respectively, with all vessels 132 to 142 being detachably connected to the dryer housing 40. In addition, the dry cleaning dryer apparatus 10 also includes a pair of pressurized gas cylinders 160 and 162 for holding odor removing gases 32 and 34, respectively, with each pressurized gas cylinder 160 and 162 being detachably connected to the dryer housing 40. Also, the dry cleaning dryer apparatus 10 further includes an air compressor 174 for providing pressurized air 14 to the dryer housing 40 of dryer apparatus 10; and a vacuum pump 182 for evacuating the pressurized air 14 from the dryer housing 40 of dryer apparatus 10. Both air compressor 174 and vacuum pump 182 are detachably connected to the dryer housing 40 of dryer apparatus 10.

Dryer housing 40, as shown in FIGS. 1 through 5, includes a front wall 42, a rear wall 44, a top wall 46, a bottom wall 48 and side walls 50 and 52, all being integrally connected to form a substantially rectangular shaped configuration which forms an upper interior compartment area 80 for holding the rotatable drum 82 therein, as well as the drum shaft assembly 94 and the pulley system assembly 106; and a lower interior compartment area 120 for holding in place the drive motor 122, the dryer filter 126 and the heating element 128 having the internal air circulation blower 130 therein.

Figure 4:
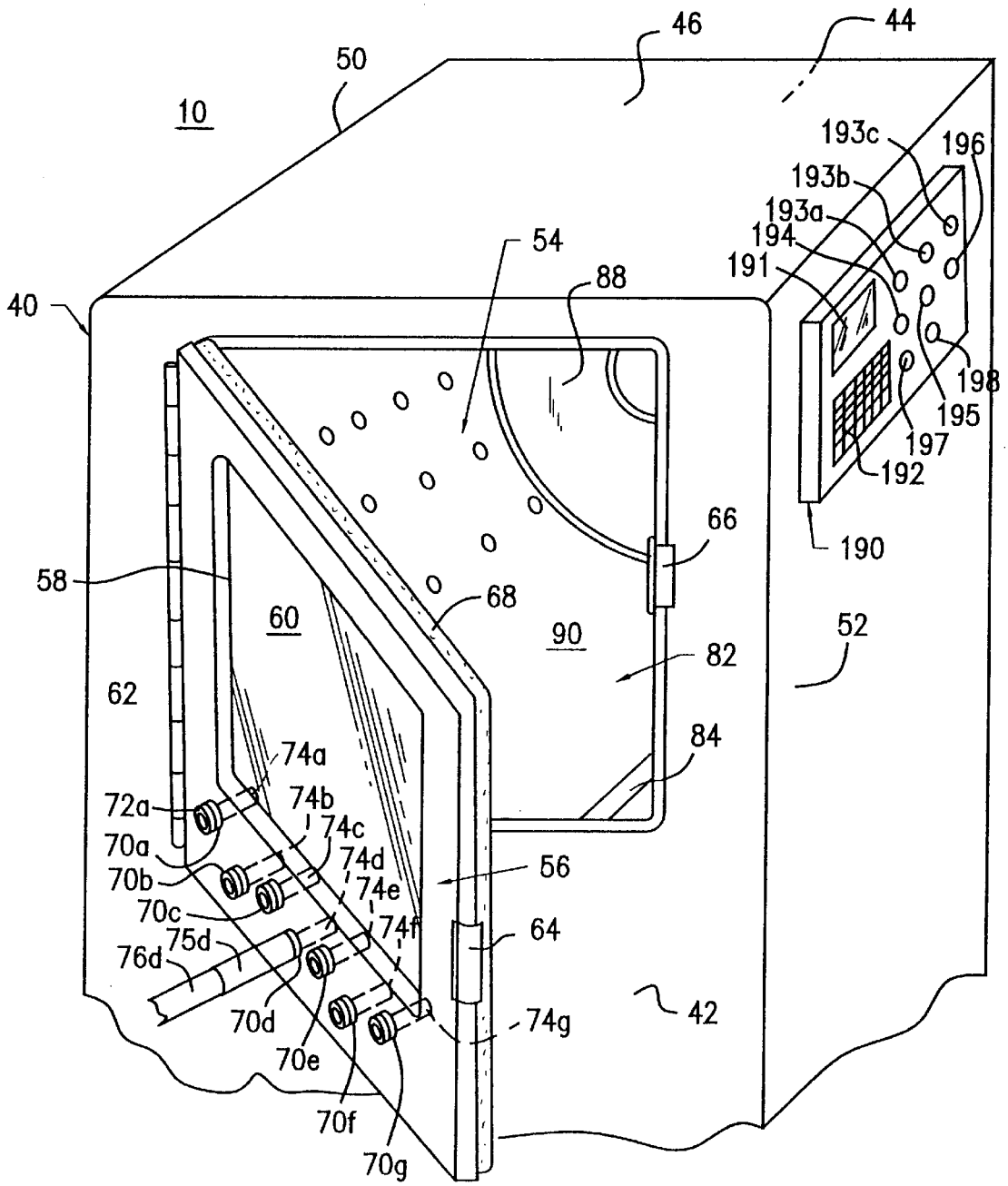
FIG. 4 is an enlarged front perspective view of the dry cleaning apparatus of the present invention showing the front door of the apparatus having a pressure lock, a sealing gasket, a hinge, a window, a plurality of quick disconnect hose couplings and spray heads.

As shown in FIG. 4, the front wall 42 of dryer housing 40 includes an opening 54 for receiving of a dryer door 56 therein. Dryer door 56 includes an opening 58 for receiving of dryer window 60 therein, a dryer hinge 62 for attaching dryer door 56 to the front wall 42, a pressure door latch 64 for detachably connecting to the latch receptacle 66 being located on the opposite side 54*a* of hinge side location 54*b*, and a sealing gasket 68 attached to the perimeter edge 56*a* of dryer door 56. Dryer door 56 further includes a plurality of openings 70*a* to 70*g* being located through the bottom front outer and inner wall areas 56*b* and 56*c* for receiving a plurality of quick disconnect female couplings 72*a* to 72*g*, respectively, on the front outer wall side 56*b*, and for receiving a plurality of sprayer head nozzles 74*a* to 74*g*, respectively, on the front inner wall side 56*c*, as shown in FIG. 4 of the drawings.

Each quick disconnect female coupling 72*a* to 72*j* includes a corresponding hose component 76*a* to 76*j*. Each hose component 76*a* to 76*j* includes a first end quick disconnect male coupling 75*a* to 75*j* and a second end quick disconnect male coupling 77*a* to 77*j*. First end quick disconnect male couplings 75*a* to 75*j* of hose components 76*a* to 76*j* detachably connects with the corresponding quick disconnect female couplings 72*a* to 72*j*. Second end quick disconnect male couplings 77*a* to 77*j* of hose components 76*a* to 76*j* detachably connects with the corresponding quick disconnect female couplings 78*a* to 78*j* of outlet piping 156*a* to 156*i*, 176 and 186 of vessels 132 to 142, gas cylinders 160 and 162, air compressor 174 and vacuum pump 182, respectively.

The rotatable garment basket or drum 82 is used for receiving the soiled clothing garments 12 to be cleaned. Drum 82 includes a front perimeter rim 84, a circular side wall 86, and a rear wall 88 for forming an interior chamber 90. Rear wall includes a center opening 92 for receiving the drum shaft assembly 94 therein. The drum shaft assembly 94 is used for transferring and supplying the ozone gas ($O_3$) 32 or the ammonia gas ($NH_3$) 34 to the interior chamber 90 of the rotatable drum 82. Drum shaft assembly 94 includes a hollow drum shaft 96, a bearing housing 98 fixed to the rear plate 100, and a gas manifold 102 for transferring the gases 32 and 34 through the hollow drum shaft 96. Additionally, drum shaft assembly 94 includes a shaft sealing gasket 104 for maintaining a separation of the bearings from the cleaning gases 32 or 34 going into the interior chamber 90 of drum 82.

Figure 5:
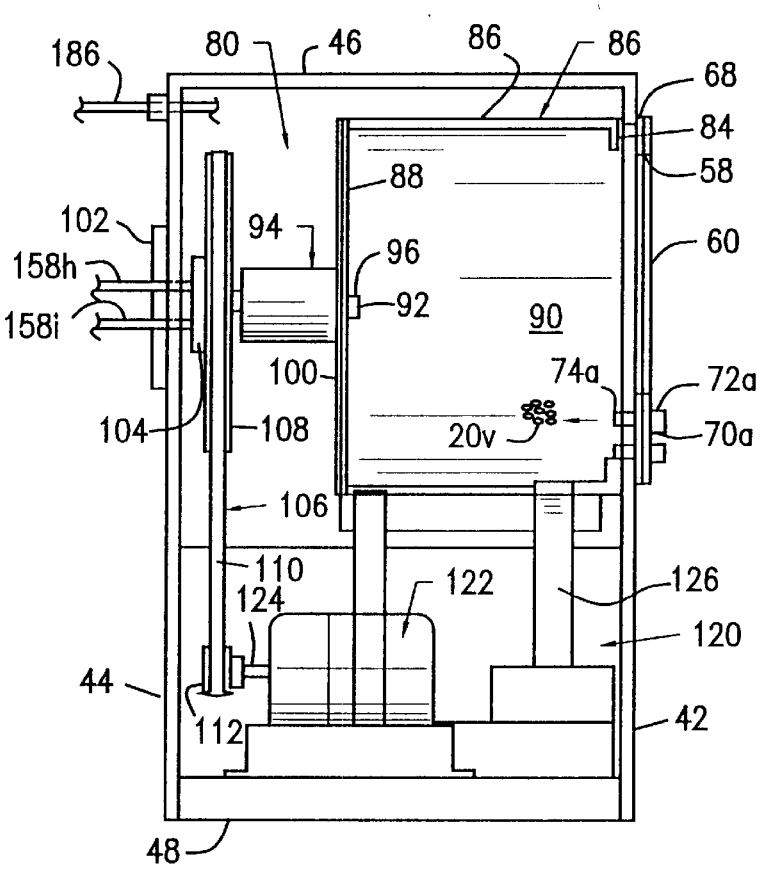
FIG. 5 is a side cross-sectional view of the dry cleaning apparatus of the present invention taken along lines 5—5 of FIG. 1 showing the rotatable drum, the motor and pulley system, the drum shaft assembly for injecting gases into the drum, the heating element with an air circulation blower, an outlet collection dryer filter for collecting particulate from the drum and the dryer door having spray head nozzles and quick disconnect couplings thereon.
Figure 6:
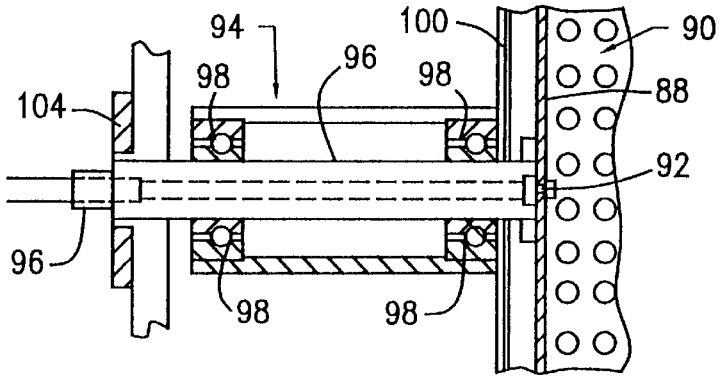
FIG. 6 is a side cross-sectional view of the dry cleaning apparatus of the present invention taken along lines 6—6 of FIG. 5 showing the drum shaft assembly for injecting gases into the drum.

The pulley system assembly 106 includes an upper pulley 108 connected to the drum shaft 96, a pulley belt 110 and a lower pulley 112 connected to the motor shaft 124 of motor 122, as shown in FIG. 5 of the drawings.

Figure 3:
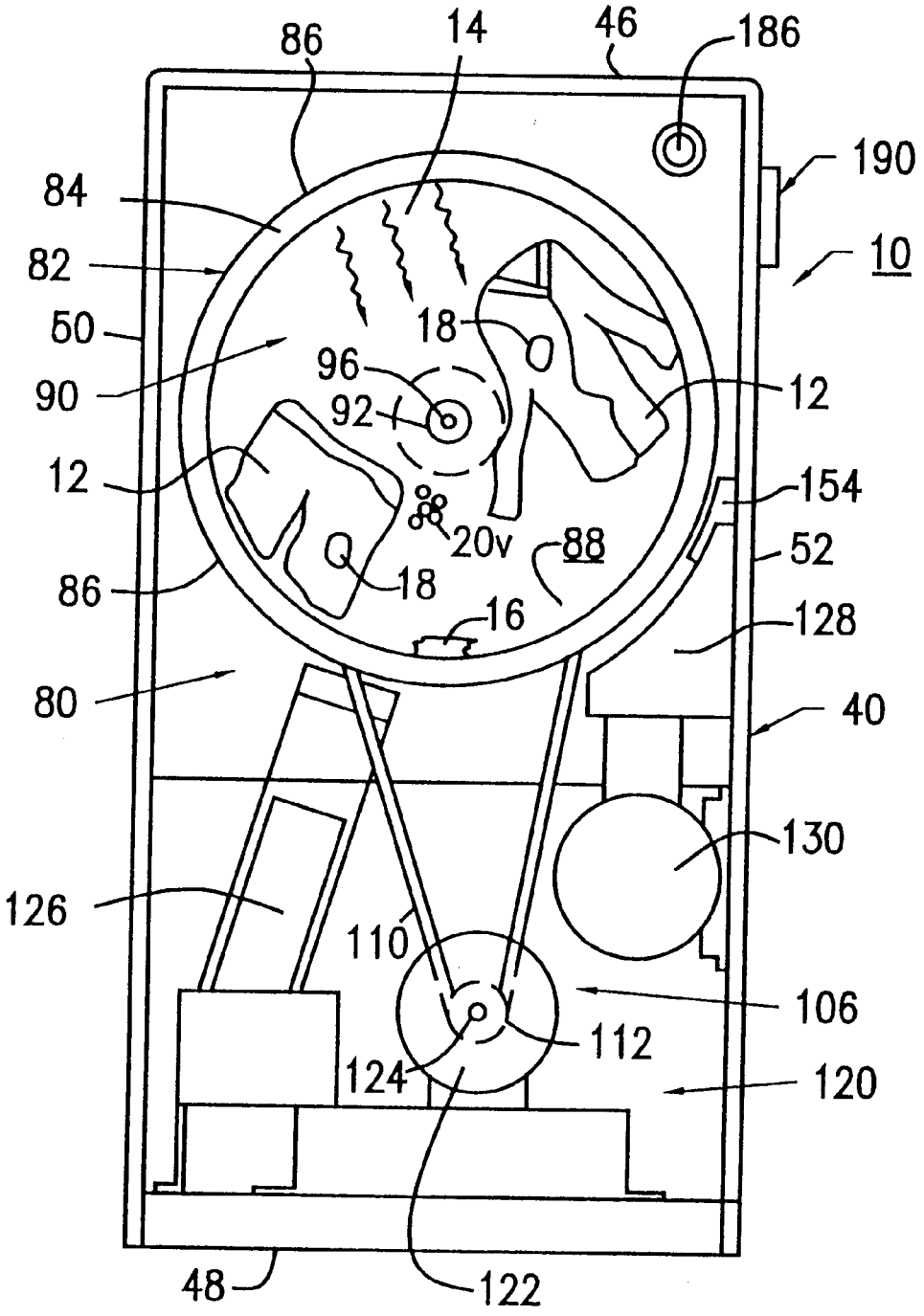
FIG. 3 is a front cross-sectional perspective view of the dry cleaning apparatus of the present invention taken along lines 3—3 of FIG. 1 showing the major internal component parts contained therein.

The lower compartment 120 of dryer housing 40, as shown in FIG. 3 of the drawings, includes a drive motor 122 having a motor shaft 124, an internal dryer filter 126 for the collection of particulate matter and/or lint 16, a heating element 128 having an internal air circulation blower 130 and having a temperature sensor 154 therein.

Each of the liquid containment vessels 132 to 142 includes an automatic pump 144*a* to 144*f*, an automatic valve 146*a* to 146*f*, an inline pressure gauge 148*a* to 148*f*, a flow gauge 150*a* to 150*f*, and a timing sensor 152*a* to 152*f*, respectively, all being connected to the vessel outlet piping 156*a* to 156*f*, as shown in FIG. 1 of the drawings. In particular, vessel 132 contains water 20 for moisturizing the fabric of a garment 12 for easier pressing; vessel 134 contains baking soda solution 22 for removing noxious acid based odors from garments 12; vessel 136 contains carbonic acid solution 24 for removing noxious acid based odors from garments 12 when ammonia treatment is not applicable; vessel 138 contains a starch sizing solution 26 for adding body to the clothing garment 12 being cleaned in which to make finishing easier; vessel 140 contains a fabric finishing solution 28 for adding luster and shine to the fabric surface of the clothing garment 12 being cleaned; and vessel 142 contains a water repellant solution 30 for waterproofing the clothing garment 12 being cleaned.

Figure 2:
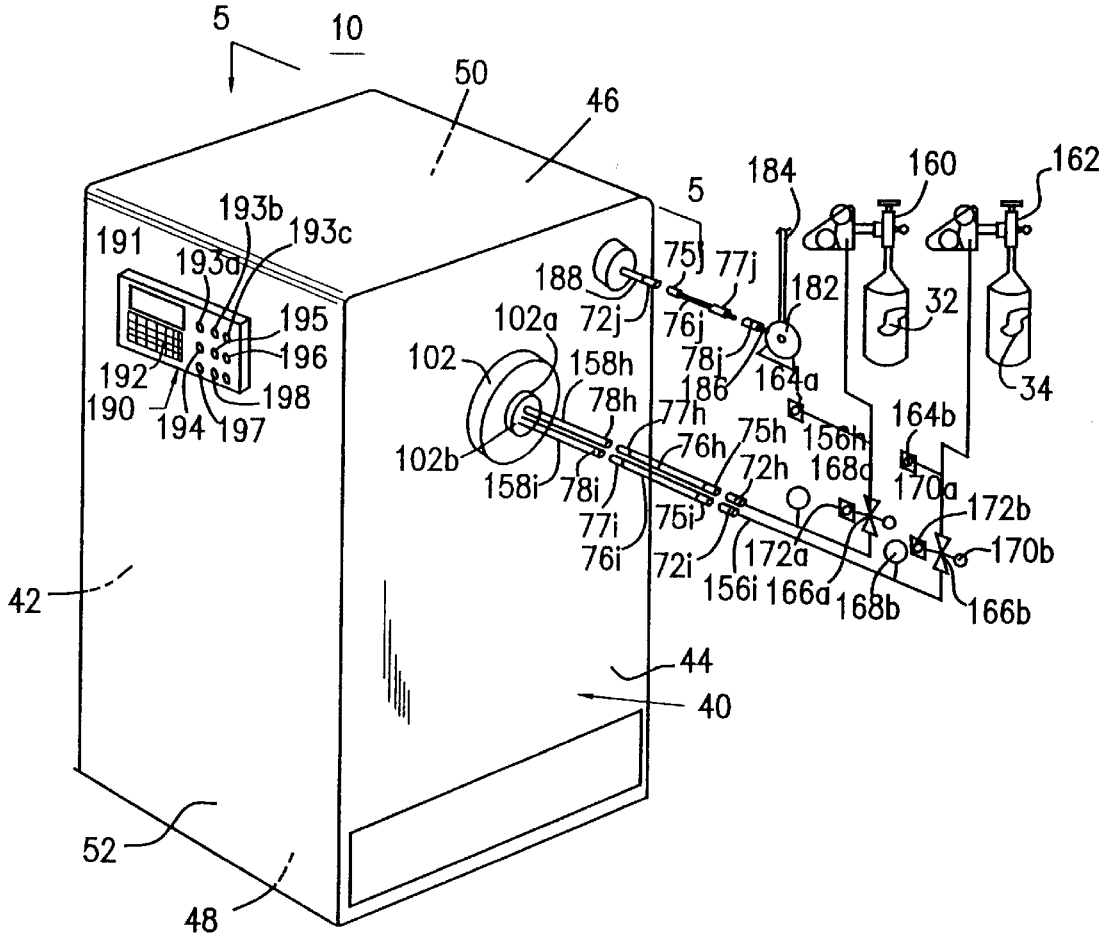
FIG. 2 is a rear perspective view of the dry cleaning apparatus of the present invention showing the major component parts contained therein.

Each of the pressurized gas cylinders 160 and 162 includes an automatic pump 164*a* and 164*b*, an automatic valve 166*a* and 166*b*, a pressure gauge 168*a* and 168*b*, a gas flow gauge 170*a* and 170*b*, and a timing sensor 172*a* and 172*b*, respectively, all being connected to the gas cylinder outlet piping 156*h* and 156*i*, as shown in FIG. 2 of the drawings. In particular, pressurized gas cylinder 160 contains ozone gas ($O_3$) 32 for removing noxious odors such as smoke, food smells, perspiration from a clothing garment 12 being cleaned; and pressurized gas cylinder 162 contains ammonia gas ($NH_3$) 34 for removing noxious acid based odors such as food smells from a clothing garment 12 being cleaned.

Apparatus 10 further includes an external air compressor 174 having an outlet pipe 176 and an oil filter 178. Compressor 174 is used for the pressurized air cleaning of garments in order to remove the soil, dirt, dust, lint 16 and stains 18 from the garments 12 being cleaned. Additionally, apparatus 10 includes a vacuum pump 182 having outlet and inlet pipes 184 and 186, respectively. Vacuum pump 182 is used in a cycling process to remove the loosened soil, dirt, dust, lint 16 and stain impurities from the drum 82 and garments 12 being processed.

Apparatus 10 includes a programmable control panel 190 for controlling several of the cleaning steps of a garment 12 being cleaned. Control panel 190 is connected to the upper side wall 52, as shown in FIG. 1 of the drawings. Control panel 190 includes a visual display screen 191, a logic controller programmer key pad 192, an ON/OFF and start buttons 193*a* to 193*c*, a plurality of sensor output components 194, 195, 196 and 197 for measuring pressure, flow rate, temperature and a time sequence, respectively and a product selector button 198 for selecting a particular vessel (s) and/or gas cylinder(s) 132 to 142 and 160 and 162 respectively. All temperature, pressure and flow rate gauges, valving, pumps are electronically and electrically connected via electrical wires 199 to the programmable control panel 190.

Operation of the Present Invention

The method of the dry cleaning process/procedure 200 for the dry cleaning of a clothing garment 12 in a dry cleaning dryer apparatus 10, is shown in FIGS. 1, 3, 7A, 7B, 7C and 7D, includes the following steps of examining/inspecting 210; stain removing 220; air flushing and feathering 230; programming the cleaning and conditioning treatments 240; dryer conditioning 250; gaseous cleaning and conditioning 260; liquid cleaning and conditioning 270; pressurized air cleaning 280; re-inspecting and examining 290; purifying and sterilizing 300; cooling 310; water conditioning 320; fabric conditioning 330; evacuating the air and particulate matter 340; and pressing 350. Processing steps 210, 220, 230, 240, 290 and 350 are performed manually by the dry cleaning operator, while processing steps 250, 260, 270, 280, 300, 310, 320, 330 and 340 are automatically performed within the interior chamber 90 of rotatable drum 82 of dryer apparatus 10.

To start the dry cleaning process 200, the dry cleaning operator initially checks and fills vessels 132 to 142 with water 20, baking soda solution 22, carbonic acid solution 24, starch sizing solution 26, fabric finishing solution 28 and water repellant solution 30 via pumps (not shown) through vessel inlet piping 158*a* to 158*f*, respectively, as depicted in FIG. 1 of the drawings. The operator then connects hose components 76*a* to 76*f* via the second end quick disconnect male couplings 77*a* to 77*f* to the quick disconnect female couplings 78*a* to 78*f* of outlet piping 156*a* to 156*f* of vessels 132 to 142, respectively. The operator then continues to connect hose components 76*a* to 76*f* via the first end quick disconnect male couplings 75*a* to 75*f* to the quick disconnect female couplings 72*a* to 72*f* attached to sprayer heads 74*a* to 74*f*, respectively, all being connected to dryer door 56. Vessels 132 to 142 are now ready for process operation for dispensing a proper liquid material 20, 22, 24, 26, 28 and/or 30 to the clothing garment 12 being cleaned.

The dry cleaning operator now proceeds to check that gas cylinders 160 and 162 are filled and pressurized with ozone and ammonia gases 32 and 34 respectively. The operator then connects hose components 76*h* and 76*i* via the second end quick disconnect male couplings 77*h* and 77*i* to the quick disconnect female couplings 78*h* and 78*i* of outlet piping 156*h* and 156*i* of pressurized gas cylinders 160 and 162, respectively. The operator then continues to connect hose components 76*h* and 76*i* via the first end quick disconnect male couplings 75*h* and 75*i* to the quick disconnect female couplings 72*h* and 72*i* attached to the gas pipe inlet openings 102*a* and 102*b* of the gas manifold 102 located on rear wall 44 of dryer housing 40. Gas cylinders 160 and 162 are now ready for process operation for dispensing a proper gas material 32 and/or 34 to the clothing garment 12 being cleaned.

The dry cleaning operator now proceeds to connect the air compressor 174 and vacuum pump 182 to the dryer housing 40. The operator then connects hose components 76*g* and 77*i* via the second end quick disconnect male coupling 77*g* and 77*j* to the quick disconnect female coupling 78*g* and 78*j* of outlet piping 176 and 186 of air compressor 174 and vacuum pump 182, respectively. The operator then continues to connect hose components 76*g* and 76*j* via the first end quick disconnect male couplings 75*g* and 75*j* to the quick disconnect female couplings 72*g* and 72*j* attached to an air inlet nozzle 74*g* and a vacuum inlet pipe 188 respectively. Air inlet nozzle 74*g* is attached to dryer door 56 and vacuum inlet pipe 188 is attached to the rear wall 44 of dryer housing 40. Air compressor 174 and vacuum pump 184 are now ready for process operation in order to pressure air clean the clothing garments 12 being cleaned.

As previously mentioned, the initial steps of examining and inspecting 210, stain removing 220, and air flushing and feathering 230, as shown in FIG. 7A, are manually performed by the operator for pre-cleaning and spot removing of stains 18 on the garment 12 to be cleaned. The operator now proceeds to turn-on the dry cleaning apparatus 10 via the ON button 193*a* to activate all pumps, valving, pressure gauges, flow gauges, timing sensors and temperature sensors within control panel 190 via electrical lines 199. The dry cleaning operator is now able to proceed with the step of programming 240, as shown in FIGS. 7B, 7C and 7D, and the optional and non-optional cleaning and conditioning treatment steps (STEPS 5, 6, 7, 8, 10, 11, 12, 13 and 14) 250, 260, 270, 280, 300, 310, 320, 330 and 340 in order to clean a particular clothing garment 12. In the step of programming 240 the operator selects the parameters for each liquid vessel 132 to 142, gas cylinder 160 and 162, air compressor 174 and vacuum pump 182 via the product selector button 198 and uses the logic controller programmer keypad 192 to program the plurality of sensor output components 194 to 197 for pressure, flow rate, temperature and time of processing, respectively, for each cleaning and/or conditioning treatment step used in the cleaning procedure 200, as previously mentioned. As shown in FIG. 1, the visual display screen 191 on control panel 190 will show, for example, in using vessel 132 having water 20 therein, what the operating conditions and parameters of pressure rate, flow rate, temperature of water and length of time sequence for the water conditioning step 320 for controlling how much water vapor 20*v* is supplied to basket chamber 90 of rotatable drum 82. Water vapor 20*v* is added to the garment 12 for increasing the moisture content of the fabric of garment 12 being cleaned to make pressing easier. Visual display screen 191 will display each of the operating conditions and parameters of processing steps 250, 260, 270, 280, 300, 310, 320, 330 and 340. The operator now presses the start button 193*c* to start the pre-determined programmable dry cleaning sequence of method 200.

In the step of gaseous cleaning and conditioning 260, the operator can use an ozone treatment 262 or an ammonia treatment 264 or both treatments 262 and 264 separately for removing of noxious odors on the clothing garments being cleaned. These treatment steps 262 and/or 264 are optional procedures and are dependent upon the odor(s) and stains 18 to be removed, if necessary, from the garment 12 being cleaned.

In the step of liquid cleaning and conditioning 270, the operator can use a baking soda solution treatment 272 or a carbonic acid solution treatment 274 or both treatments 272 and 274 separately for removing of noxious odors on the clothing garment 12 being cleaned. These treatment steps 272 and 274 are optional procedures and are dependent upon the odor(s) to be removed, if necessary, from the clothing garment being cleaned.

In the step of pressurized air cleaning 280, the interior chamber 90 of rotatable drum 82 is pressurized for removing of extraneous particulate matter such as soil, dirt, dust, lint 16 and stains 18 as the clothing garment 12 is being cleaned. The intensity of the air pressure within chamber 90 is dependent upon the type of fabric being cleaned, where a higher air pressure is used for cleaning furs, leathers and suedes and a lower air pressure can be used for cleaning of silks, nylons and rayons. The vacuum pump 182 is used in a cycling process in order to remove the loosened aforementioned extraneous particulate matter and impurities from drum 82 and clothing garments 12 being processed via filter 126.

In the step of water conditioning 320, water vapor 20*v* is supplied to the basket chamber 90 of rotatable drum 82 via spray head 74*a* where the water vapor 20*v* is used to increase the moisture content of the fabric being cleaned. This increase in the moisture content of the garment 12 being cleaned makes the pressing step 15 easier.

In the step of fabric conditioning 330, the operator can use a starch sizing solution treatment 332; or a fabric surface and conditioning solution treatment 334; or a water repellant solution treatment 336, or all three treatments 332, 334 and 336 separately for sizing the fabric, or for surface conditioning the fabric or for waterproofing the fabric, respectively. These treatment steps 332, 334 and 336 are optional procedures and are solely dependent upon the discretion of the dry cleaning operator and/or customer for the garment 12 being cleaned.

Advantages of the Present Invention

Accordingly, an advantage of the present invention is that it provides for an improved method and apparatus for the dry cleaning of clothing made from various types of fabrics, leathers and furs using environmentally safe dry cleaning liquids which provide a safe dry cleaning procedure that reduces the operating costs of dry cleaning equipment, dry cleaning materials, labor, management record keeping for various governmental agencies and overhead expense.

Another advantage of the present invention is that it provides for an improved dry cleaning apparatus and method that will eliminate odors, the need for auxiliary equipment or solvent containment rooms, the need for hazardous waste removal by a licensed waste removal company and the need for dry cleaning machines using dry cleaning solvents such as perchlorethylene.

Another advantage of the present invention is that it provides for an improved dry cleaning apparatus and method that reduces the intervention and record keeping required by various Federal, State, County and City governmental agencies such as the EPA, OSHA, DEP and the Health Department.

Another advantage of the present invention is that it provides for an improved dry cleaning apparatus and method that give customers options of alternate cleaning procedures and processes which are environmentally safe to the health of the dry cleaning operators and customers, as well as being environmentally safe to the surrounding areas of the dry cleaning establishments.

Another advantage of the present invention is that it provides for an improved dry cleaning apparatus and method that avoids the problems of fabric shrinkage; fabric dye bleeding; loss of color in the fabric; fabric fusing; melted beads; coating separations within the fabric; loss of fabric texture, feel and body; lack of fabric luster; and other associated problems that can arise in either chemical dry cleaning or wet cleaning procedures being used at present.

Another advantage of the present invention is that it provides for an improved dry cleaning apparatus that is pressurized by air and the amount of air pressure can be regulated depending upon the fabric being cleaned.

Another advantage of the present invention is that it provides for an improved dry cleaning apparatus that receives a variety of gases such as ozone, ammonia or other cleaning gases for the removal of noxious odors like smoke, sweat/perspiration, garlic/onion smells, and the like.

Another advantage of the present invention is that it provides for an improved dry cleaning apparatus that applies a moisture spray to the garment being cleaned to increase the moisture content of the fabric in order to make pressing of the garment easier.

Another advantage of the present invention is that it provides for an improved dry cleaning apparatus that applies a starch sizing solution to the garment being cleaned to add body to the fabric in order to make pressing and finishing of the clean garment easier.

Another advantage of the present invention is that it provides for an improved dry cleaning apparatus that applies a fabric surface finishing solution to the garment being cleaned to add luster and shine to the fabric in order to make finish pressing of the garment easier.

Another advantage of the present invention is that it provides for an improved dry cleaning apparatus that applies a water repellant solution to the garment being cleaned for water repellency of the fabric in order to make the garment water proof.

Another advantage of the present invention is that it provides for an improved dry cleaning method that uses environmentally safe cleaning liquids such as biodegradable wetside lubricants to remove odors, fatty acid and salt stains caused by perspiration of underarm and crotch areas; the use of acids, tannin formulas and bleach to remove tannin stains caused by coffee, tea, soft drinks, soy sauce, mustard and the like; the use of alkalis, protein formulas and bleach to remove protein stains caused by egg, milk, blood, living body matter and the like; and the use of nonionic detergents to remove dryside stains caused by grease, oils, dyes, waxes and the like.

A further advantage of the present invention is that it provides for an improved dry cleaning apparatus that can be mass produced in an automated and economical manner and is readily affordable by the dry cleaning owner.

A still further advantage of the present invention is that it provides an improved dry cleaning method that reduces the overall dry cleaning operating costs in dry cleaning of garments in order to reduce dry cleaning prices to the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A dry cleaning apparatus comprising:

a) a housing having a door and an internal rotatable drum for receiving clothes to be cleaned;

b) means for rotating said drum;

c) means for heating the clothes in said drum;

d) a first hose connected to said housing for supplying pressurized air to said drum;

e) a second hose connected to said housing for supplying water or water vapor to the clothes in said drum;

f) a third hose and vacuum pump connected to said housing for evacuating air and/or fine particulate matter from said drums;

g) a fourth hose connected to said housing for supplying a baking soda solution to said housing for removing odors from the clothes in said drum; and first means for controlling the amount of said baking soda solution supplied to said housing; and h) a fifth hose connected to said housing for supplying a carbonic acid solution to said housing for removing odors from the clothes in said drum; and second means for controlling the amount of said carbonic acid solution supplied to said housing.

2. A dry cleaning apparatus in accordance with claim 1, further including a sixth hose connected to said housing for supplying a sizing solution to the clothes in said drum for easier pressing.

3. A dry cleaning apparatus in accordance with claim 1, further including a seventh hose connected to said housing for supplying a fabric finishing solution to the clothes in said drum for easier pressing.

4. A dry cleaning apparatus in accordance with claim 1, further including an eighth hose connected to said housing for supplying a water repellant solution for waterproofing the clothes in said drum.

5. A dry cleaning apparatus in accordance with claim 1, further including a ninth hose connected to said housing for supplying an ozone ($O_3$) gas for removing odors from the clothes in said drum.

6. A dry cleaning apparatus in accordance with claim 1, further including a tenth hose connected to said housing for supplying an ammonia ($NH_3$) gas for removing odors from the clothes in said drum.

7. A dry cleaning apparatus in accordance with claim 1, wherein said means for heating include a heating element having an air circulation blower connected to said apparatus.

8. A dry cleaning apparatus in accordance with claim 1, further including a filter device connected to said housing for collecting of particulate matter removed from clothes in said drum.

9. A dry cleaning apparatus in accordance with claim 1, wherein said first hose has a first end and a second end, said first end being connected to said door, and said second end being connected to an air compressor.

10. A dry cleaning apparatus in accordance with claim 1, wherein said second hose has a first end and a second end, said first end being connected to said door, and said second end being connected to a vessel containing water.

11. A dry cleaning apparatus in accordance with claim 1, wherein said third hose has a first end and a second end, said first end being connected to said housing, and said second end being connected to said vacuum pump.

12. A dry cleaning apparatus in accordance with claim 2, wherein said fourth hose has a first end and a second end, said first end being connected to said door, and said second end being connected to a vessel containing a baking soda solution.

13. A dry cleaning apparatus in accordance with claim 3, wherein said fifth hose has a first end and a second end, said first end being connected to said door, and said second end being connected to a vessel containing a carbonic acid solution.

14. A dry cleaning apparatus in accordance with claim 2, wherein said sixth hose has a first end and a second end, said first end being connected to said door, and said second end being connected to a vessel containing a sizing solution.

15. A dry cleaning apparatus in accordance with claim 3, wherein said seventh hose has a first end and a second end, said first end being connected to said door, and said second end being connected to a vessel containing a fabric finishing solution.

16. A dry cleaning apparatus in accordance with claim 4, wherein said eighth hose has a first end and a second end, said first end being connected to said door, and said second end being connected to a vessel containing a water repellant solution.

17. A dry cleaning apparatus in accordance with claim 5, wherein said ninth hose has a first end and second end, said first end being connected to said housing, and said second end being connected to a pressurized gas cylinder containing ozone ($O_3$) gas.

18. A dry cleaning apparatus in accordance with claim 6, wherein said tenth hose has a first end and a second end, said first end being connected to said housing, and second end being connected to a pressurized gas cylinder containing ammonia ($NH_3$) gas.

19. A dry cleaning apparatus in accordance with claim 1, further including a programmable control panel for controlling time, temperature, pressure and rate of flow of liquids and gases.

20. A dry cleaning apparatus in accordance with claim 9, further including means for disconnecting said first hose from said door.

21. A dry cleaning apparatus in accordance with claim 10, further including means for disconnecting said second hose from said door.

22. A dry cleaning apparatus in accordance with claim 1, wherein said first means for controlling includes a first valve for supplying said baking soda solution to said housing, and a first controller for controlling the rate of flow of said baking soda solution to said housing.

23. A dry cleaning apparatus in accordance with claim 1, wherein said second means for controlling includes a second valve for supplying said carbonic acid solution to said housing, and a second controller for controlling the rate of flow of said carbonic acid solution to said housing.

* * * * *